United States Patent [19]

Rich et al.

[11] Patent Number: 4,506,856

[45] Date of Patent: Mar. 26, 1985

[54] LOCKABLE PEGBOARD HOOK CONSTRUCTION

[75] Inventors: Michael Rich, Newtown; F. Donald Ek, Brookfield, both of Conn.

[73] Assignee: Tenax Corporation, Danbury, Conn.

[21] Appl. No.: 480,232

[22] Filed: Mar. 30, 1983

[51] Int. Cl.[3] ..... E04G 5/06

[52] U.S. Cl. ..... 248/222.1; 248/221.2

[58] Field of Search ..... 248/222.1, 220.3, 220.4, 248/221.1, 221.2, 223.1; 211/192

[56] References Cited

U.S. PATENT DOCUMENTS

| | | | |
|---|---|---|---|
| 2,312,985 | 3/1943 | Bales | 248/221.2 |
| 3,163,392 | 12/1964 | Husted | 248/221.2 |
| 3,319,917 | 5/1967 | Bilodeau | 248/221.2 |
| 3,401,909 | 9/1968 | Kalahar | 248/221.2 |
| 4,303,217 | 12/1981 | Garfinkle | 248/221.2 |
| 4,319,730 | 3/1982 | Thalenfeld | 248/220.4 |
| 4,405,110 | 9/1983 | Gibbons | 248/221.2 |

FOREIGN PATENT DOCUMENTS

| | | | |
|---|---|---|---|
| 1237597 | 6/1971 | United Kingdom | 248/221.2 |

*Primary Examiner*—J. Franklin Foss

*Attorney, Agent, or Firm*—Kramer and Brufsky

[57] ABSTRACT

A perforated panel hook construction having a hinged, fold-over locking flap extending downwardly from a free end thereof. The flap is provided with a peg adapted to be inserted in a hole in a perforated panel in interfering engagement with a mounting pin for the hook to firmly secure and lock the hook in place on the perforated panel.

10 Claims, 5 Drawing Figures

LOCKABLE PEGBOARD HOOK CONSTRUCTION

BACKGROUND OF THE INVENTION

1. Field of the Invention

This invention relates to a hook adapted to be releasably engaged with a perforated panel or apertured panel and provided with means to lock the hook to the perforated panel to prevent displacement of the hook therefrom.

2. Description of the Prior Art

The use of perforated panel and hooks and/or brackets mounted thereon to support and display articles on the perforated panel are well known. In the use of the conventional perforated panel and hook and/or bracket arrangement, some apparent disadvantages have arisen. In general, a main source of difficulty lies in the likelihood of the hook or bracket to be either displaced laterally on the perforated panel or to be subject to being pulled loose from the perforated panel by the weight of an article supported on the hook or bracket.

Perforated panel hooks are usually constructed in the form of an elongated shank designed to overlie the base surface of the planar surface of a perforated panel. One end of the shank usually is provided with an offset end portion designed to be inserted into an aperture in the perforated panel to overlie the opposed surface of the perforated panel to hold the hook in engagement with the perforated panel. A support element, such as a hooked portion or bracket is placed on the shank at the other end and as stated, the support end can merely take the form of a counterturned or arcuate end portion of the shaft itself. Articles are placed upon or suspended from the counterturned or support end of the hook for display purposes. However, the hook may readily be moved laterally thereby causing the suspended articles to be dislodged, or the hook itself pulled under the weight of the article from the perforated panel to which it is attached, thereby defeating the entire purpose of the device.

Accordingly, it is an object of the present invention to provide a perforated panel hook construction having locking means whereby the hook may be retained in releasable engagement with a perforated panel, but will be prevented from being inadvertently moved laterally or otherwise disengaged from the perforated panel without a positive disengagement force applied to the hook construction.

SUMMARY OF THE INVENTION

In accordance with the present invention a perforated panel hook construction is provided having a fold-over locking flap operative to be inserted into snapping engagement in a hole in a perforated panel to firmly secure the hook in place on the perforated panel.

The hook construction is provided with a planar base portion adapted to lie flat on an apertured perforated panel. A hook or bracket portion extends generally perpendicularly from one side of the base. Extending from the opposite side of the planar base are top and bottom, vertically spaced alignment pins. Each alignment pin projects generally perpendicularly rearwardly from the base in a direction opposed to the hook or bracket portion. Each pin is inserted into a different vertically spaced pegboard hole in order to mount the hook or bracket portion on the perforated. The bottom alignment pin is received in its hole on the perforated panel with clearance.

Connected to the planar base portion of the hook construction is an integral fold-over locking flap having a living-hinge which extends across the width of the flap. The flap is generally planar and has an arcuate perpendicular extending locking peg adjacent its free end but spaced upwardly therefrom. The locking peg extends in the same direction as the hook or bracket portion.

The flap is movable between an unlocked position in which the locking peg is remote from the bottom hole in the perforated panel, and a locked position in which the locking peg is received through a hole in the planar base of the hook construction which is placed in alignment with the hole in the perforated panel receiving the bottom alignment pin of the hook construction. The peg enters the pegboard hole with snap-type action into the clearance space in the bottom perforated panel hole between the hole and the bottom alignment pin when the flap is pivoted about the living-hinge axis. When the locking peg is received in the bottom perforated panel hole, it forms an interference-type fit with the bottom alignment pin extending rearwardly from the planar base portion of the perforated panel hook construction to lock the hook to the perforated panel.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
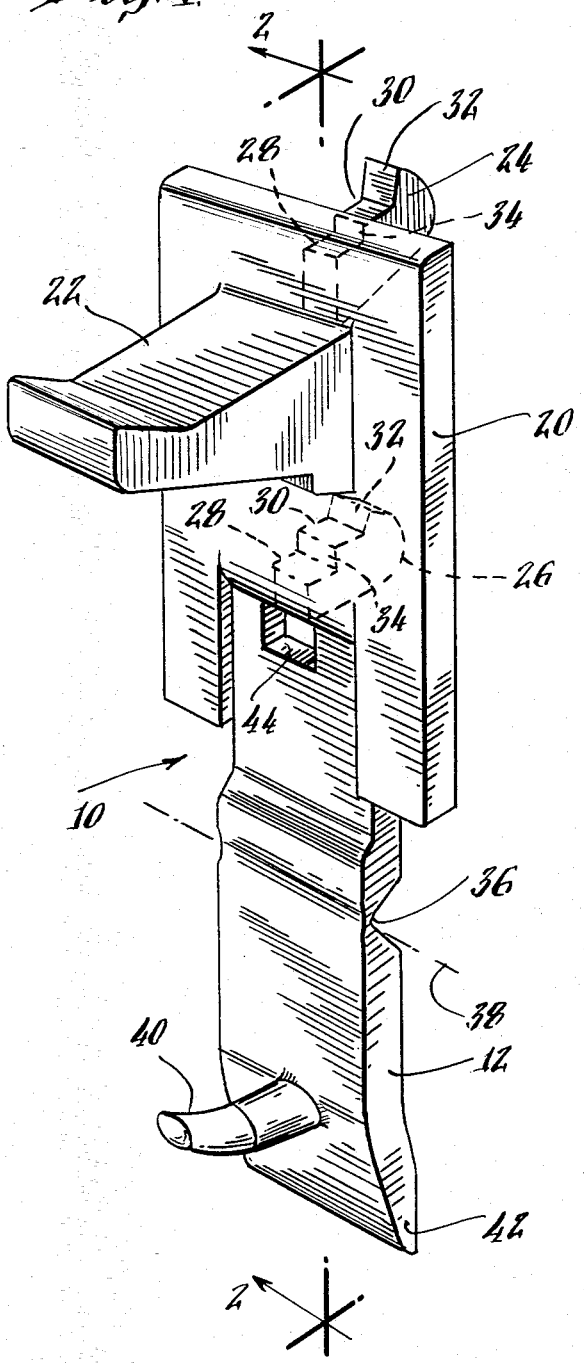
FIG. 1 is a perspective view of the perforated panel hook construction of the present invention mounted on a perforated panel prior to being locked to the perforated panel.

Referring now to the drawing in detail, wherein like elements indicate like parts throughout the several views, the perforated panel hook construction of the present invention is generally indicated by the numeral 10.

The perforated panel hook construction 10 has a fold-over locking flap 12 operative to be inserted into snapping engagement in a hole 14 in a pegboard 16 to firmly secure the hook construction in place on the perforated panel 16.

Figure 2:
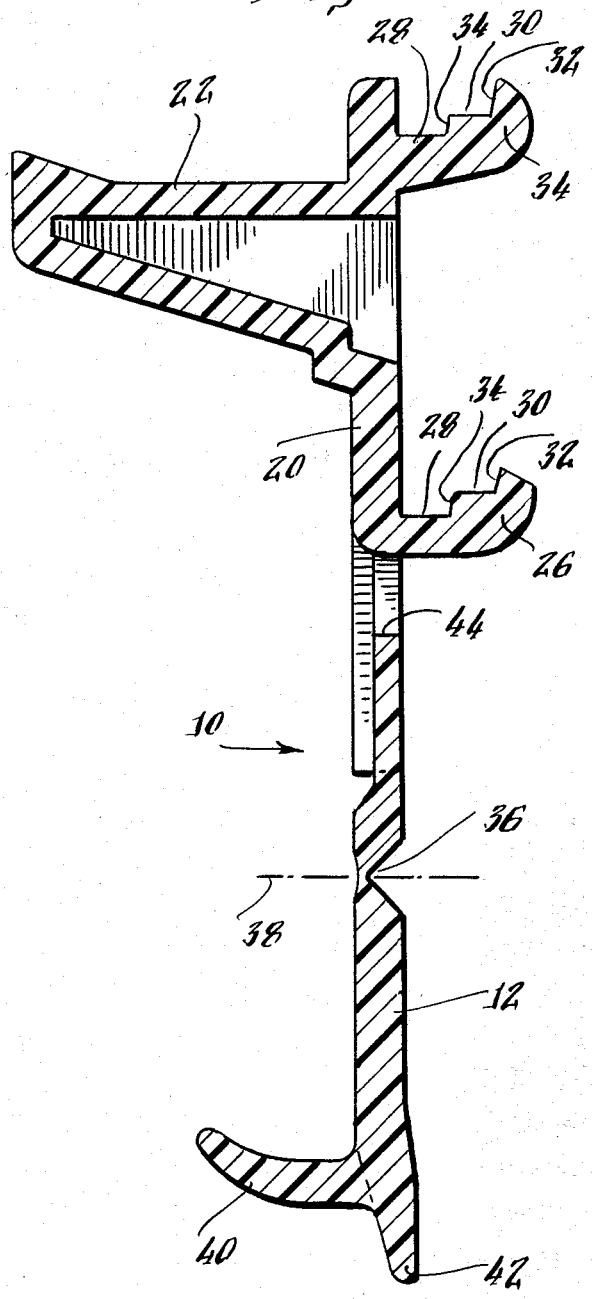
FIG. 2 is a cross-sectional view of the hook construction of FIG. 1 taken substantially along the plane indicated by line 2—2 of FIG. 1.
Figure 3:
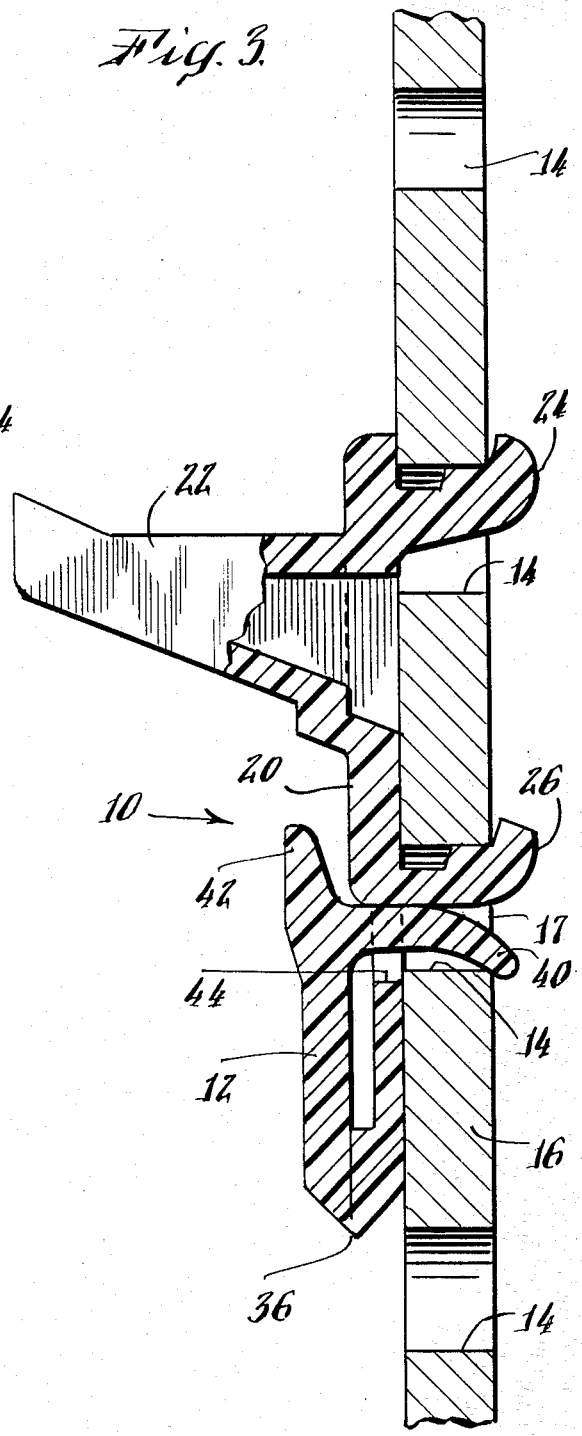
FIG. 3 is an enlarged view similar to FIG. 2, but with the hook construction locked to the perforated panel.
Figure 4:
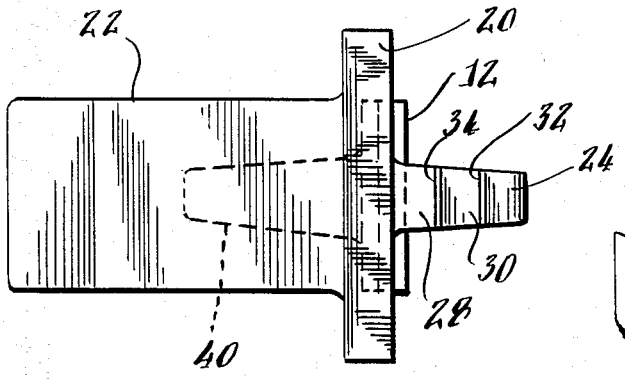
FIG. 4 is a top plan view of the hook construction of FIG. 2.
Figure 5:
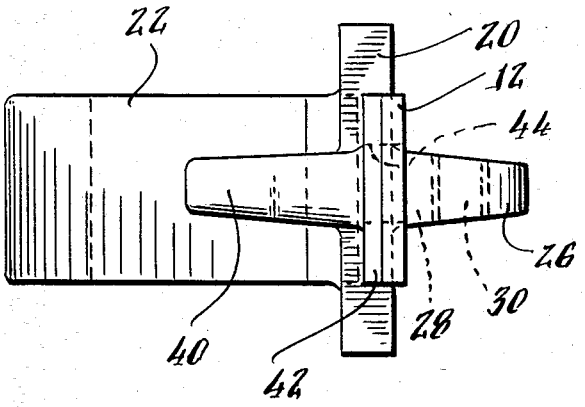
FIG. 5 is a bottom plan view of the hook construction of FIG. 2.

The hook construction 10 is provided with a planar base portion 20 adapted to lie flat on the apertured perforated panel 16. A hook or bracket portion 22 extends generally perpendicularly from one side of the base. Extending from the opposite side of the planar base portion 20 are top and bottom, vertically spaced, alignment pins 24, 26. Each alignment pin 24, 26 projects generally perpendicularly rearwardly from the base 20 in a direction opposed to the hook or bracket portion 22. Each pin is inserted into a different vertically spaced pegboard hole 14 in order to mount the hook or bracket portion on the perforated panel 16 and has a pair of contiguous, stepped portions 28, 30 of different heights to fit within different diameter holes 14 in a standard apertured perforated panel 16. The pins 24, 26 support the hook or bracket portion 22 on the perforated panel 16 when an article (not shown) is supported on or hung from the hook or bracket portion 22. Under load, the base portion 20 will tend to rotate in a counterclockwise direction relative to perforated panel 16, causing pin surfaces 32 or 34 to contact the rear of perforated panel 16 to frictionally retain the hook construction 10 mounted on the perforated panel 16. As shown in FIGS. 2 and 3 the bottom alignment pin 26 is received in its hole 14 on the perforated panel 16 with clearance 17.

Connected to the planar base portion 20 of the hook construction 10 is the integral fold-over locking flap 12 which has a living-hinge 36 which extends across the width of the flap 12 along an axis 38. The flap 12 is generally planar and has an arcuate perpendicular extending locking peg 40 adjacent its free end 42 but spaced upwardly therefrom. The locking peg 40 extends in the same direction as the hook or bracket portion 22.

The flap 12 is movable between an unlocked position in which the locking peg 40 is remote from the bottom hole 14 in the perforated panel 16, and a locked position in which the locking peg 40 is received through a hole 44 in the planar base 20 of the hook construction 10 which is placed in alignment with the hole 14 in the perforated panel 16 receiving the bottom alignment pin 26 of the hook construction. The peg 40 enters the perforated panel hole with snap-type action into the clearance space 17 in the bottom perforated panel hole between the hole and the bottom alignment pin 26 when the flap is pivoted about the living-hinge axis 38. When the locking peg 40 is received in the bottom pegboard hole 14, it forms an interference-type fit with the bottom alignment pin 26 extending rearwardly from the planar base portion 20 of the perforated panel hook construction 10 to lock the hook construction to the perforated panel to prevent it from being laterally displaced or from becoming loose and disengaged from the perforated panel when bracket or support portion 22 is under load.

What is claimed as new is:

1. A perforated panel hook construction adapted to overlie a first surface of a perforated panel having spaced horizontal and vertical apertures therethrough comprising:

a substantially planar shank portion, said shank portion including adjacent one end thereof:

at least one rearwardly projecting pin portion which is adapted to extend through one of said apertures in said perforated panel to attach said hook construction to a perforated panel, a forwardly projecting support portion on said shank portion adapted to serve as a support for items to be supported by said hook construction on said perforated panel, said rearwardly projecting pin portion not filling the aperture in said perforated panel through which it is inserted thereby providing a clearance opening therethrough, and locking means secured to said shank portion to lock said hook in overlying engagement with said perforated panel, said locking means including, a substantially planar downwardly extending locking flap mounted on said shank portion for pivotable movement about a hinge axis extending across the width of said shank, and a generally perpendicular locking peg adjacent to the free end of said locking flap extending forwardly therefrom in the same direction as the support portion of said hook construction, said locking peg being adapted to be moved between an unlocked position remote from the aperture in said perforated panel receiving said rearwardly extending pin portion and a locked position in which said locking peg is received in snap-type engagement in the clearance opening of said perforated panel in an interference fit with said rearwardly extending pin portion.

2. The perforated panel hook construction of claim 1 wherein said fold-over locking flap includes:

a living hinge construction along said hinge axis.

3. The perforated panel hook construction of claim 1 wherein said planar shank portion includes:

an opening therethrough beneath said rearwardly extending pin portion adapted to receive the locking peg therethrough.

4. The perforated panel hook construction of claim 1 wherein said locking peg includes:

an arcuate portion extending upwardly towards said support portion.

5. The perforated panel hook construction of claim 1 wherein said planar shank portion includes:

a pair of vertically spaced and aligned rearwardly extending pin portions each of which is adapted to extend through one of pair of vertically spaced apertures in said perforated panel, and the lowermost one of said vertically spaced pin portion provides the clearance opening with said perforated panel aperture for receiving said locking peg.

6. The perforated panel hook construction of claim 5 wherein each of said pin portions includes a pair of stepped engagement surfaces for contact with a surface of a perforated panel.

7. The perforated panel hook construction of claim 5 wherein said fold-over locking flap includes:

a living hinge construction along said hinge axis.

8. The perforated panel hook construction of claim 7 wherein said planar shank portion includes:

an opening therethrough beneath said rearwardly extending pin portion adapted to receive the locking peg therethrough.

9. The perforated panel hook construction of claim 8 wherein said locking peg includes:

an arcuate portion extending upwardly towards said support portion.

10. A perforated panel hook construction adapted to overlie a first surface of a perforated panel having spaced horizontal and vertical apertures therethrough comprising:

a substantially planar shank portion, said shank portion including:

a pair of vertically spaced and aligned rearwardly projecting pin portions each of which is adapted to extend through one of a pair of vertically spaced apertures in said perforated panel to attach said hook construction to a perforated panel, each of said pin portions including a pair of stepped engagement surfaces for contact with a surface of a perforated panel, a forwardly projecting support portion on said shank portion adapted to serve as a support for items to be supported by said hook construction on said perforated panel, the lowermost one of said rearwardly projecting pin portions not filling the aperture in said perforated panel through which it is inserted thereby providing a clearance opening therethrough, an opening in said shank portion beneath the lowermost one of said rearwardly projecting pin portions, and locking means secured to said shank portion to lock said hook in overlying engagement with said perforated panel, said locking means including a substantially planar downwardly extending locking flap mounted on said shank portion for pivotable movement about a living hinge construction forming a hinge axis extending across the width of said shank, and a generally perpendicular locking peg adjacent to the free end of said locking flap extending forwardly therefrom in the same direction as the support portion of said hook construction, said locking peg being adapted to be moved between an unlocked position remote from the aperture in said perforated panel receiving said rearwardly extending pin portion and a locked position in which said locking peg is received through the opening in said shank portion beneath the lowermost one of said rearwardly extending pin portions and into snap-type engagement in the clearance opening of said perforated panel in an interference fit with said rearwardly extending pin portion, said locking peg including an arcuate portion extending upwardly towards said support portion.

* * * * *